United States Patent [19]

MacNair

[11] 4,148,419

[45] Apr. 10, 1979

[54] AEROSOL VALVE ASSEMBLY HAVING GAS DIFFUSER FOR CHARGING

[75] Inventor: Leonard I. MacNair, Greenford, England

[73] Assignee: Metal Box Limited, Berkshire, England

[21] Appl. No.: 823,917

[22] Filed: Aug. 12, 1977

[51] Int. Cl.[2] ..... B65D 83/14; B65B 3/04

[52] U.S. Cl. ..... 222/189; 141/20; 141/286; 222/402.16; 222/464

[58] Field of Search ..... 141/3, 20, 286; 222/1, 222/402.16, 402.24, 464, 189, 400.7, 564

[56] References Cited

U.S. PATENT DOCUMENTS

| | | | |
|---|---|---|---|
| 2,039,902 | 5/1936 | Healy | 222/402.16 X |
| 2,305,286 | 12/1942 | Ward | 222/402.16 X |
| 2,815,889 | 12/1957 | Stetz et al. | 222/464 X |
| 3,184,118 | 5/1965 | Webster | 222/464 X |
| 3,209,954 | 10/1965 | Webster | 222/402.24 X |
| 3,845,887 | 11/1974 | Meuresch | 222/402.16 |
| 4,045,525 | 8/1977 | Huggins | 222/400.7 X |

*Primary Examiner*—David A. Scherbel
*Attorney, Agent, or Firm*—Guy A. Greenawalt

[57] ABSTRACT

A valve for an aerosol container, of the kind which is adapted to pass propellant into the container to pressurize the aerosol product, has a dip tube which is arranged to act as a diffuser. The propellant is thereby caused to enter the product as a large number of small bubbles rather than a much smaller number of larger bubbles. By thus improving the rate of solution of the propellant in the product the propellant charging times can be substantially reduced.

5 Claims, 6 Drawing Figures

AEROSOL VALVE ASSEMBLY HAVING GAS DIFFUSER FOR CHARGING

This invention relates to valve assemblies for aerosol containers, particularly of the kind of which the valves are adapted to pass a pressure medium into the product to be dispensed for pressurising the product. Such valves are hereinafter referred to as pressure filling valves. The invention is of particular application where the pressure medium is introduced in gaseous form, e.g. pressurised carbon dioxide or nitrous oxide, but may be used with advantage where the pressure medium is liquified, e.g. FREON (Registered Trade Mark).

A difficulty which is often encountered with the use of a gaseous pressurising medium for an aerosol product occurs by reason of the high pressures and flow rates which are desirably used in order to minimise the filling time required. The solubility of the pressurising medium in the aerosol product may be insufficient to prevent a temporary increase of pressure to levels at which the container bursts or substantially distorts.

The present invention has as a primary object to provide a valve assembly for an aerosol container which, by substantially increasing the rate at which the pressurising medium dissolves in the aerosol product, enables higher pressures and flow rates to be safely used for the pressurising medium than would otherwise have been available.

In accordance with the invention from one aspect there is provided a valve assembly for an aerosol container, which comprises a pressure filling valve and a dip tube attached to the valve and extending therefrom to a free end so as in normal use to pass a product to be dispensed to the valve from a remote end of the container body to which the valve is fitted, the valve assembly having a plurality of holes provided at or adjacent the end of the dip tube and communicating with the bore of the dip tube, the arrangement being such that pressurising medium passed along the dip tube to the free end thereof during pressurisation of an aerosol product emerges into the product finely divided into small bubbles.

Other aspects and features of the invention will become apparent from the following description of embodiments thereof, given by way of example and with reference to the accompanying drawings. In the drawings.

Figure 3:
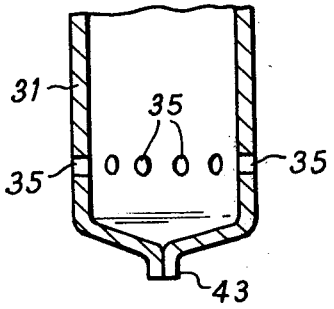
Figure 4:
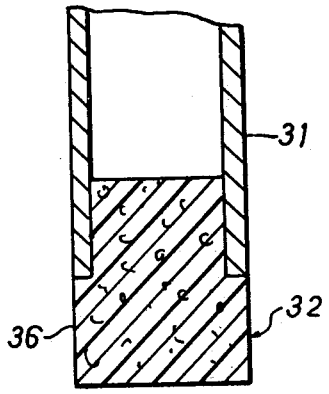
Figure 5:
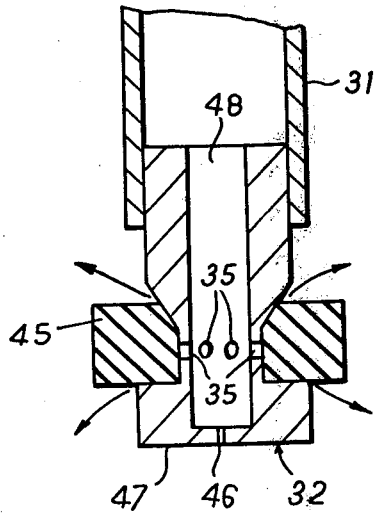

FIG. 3 similarly shows the dip tube of the third valve;

FIG. 4 similarly shows the dip tube of the fourth valve;

FIG. 5 similarly shows the dip tube of the fifth valve, and

Figure 6:
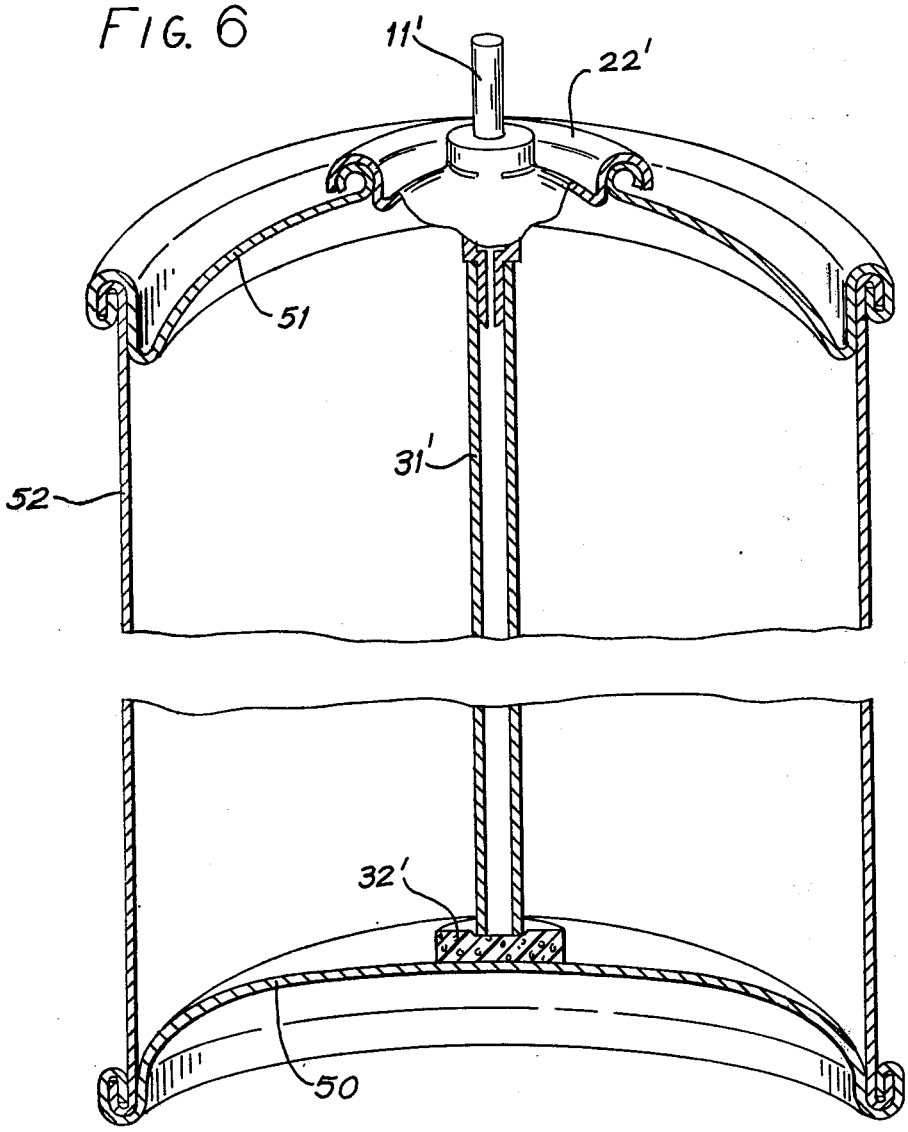

FIG. 6 shows an aerosol container assembly with a valve having a dip tube with a further form of diffuser member at the bottom end thereof.

Figure 1:
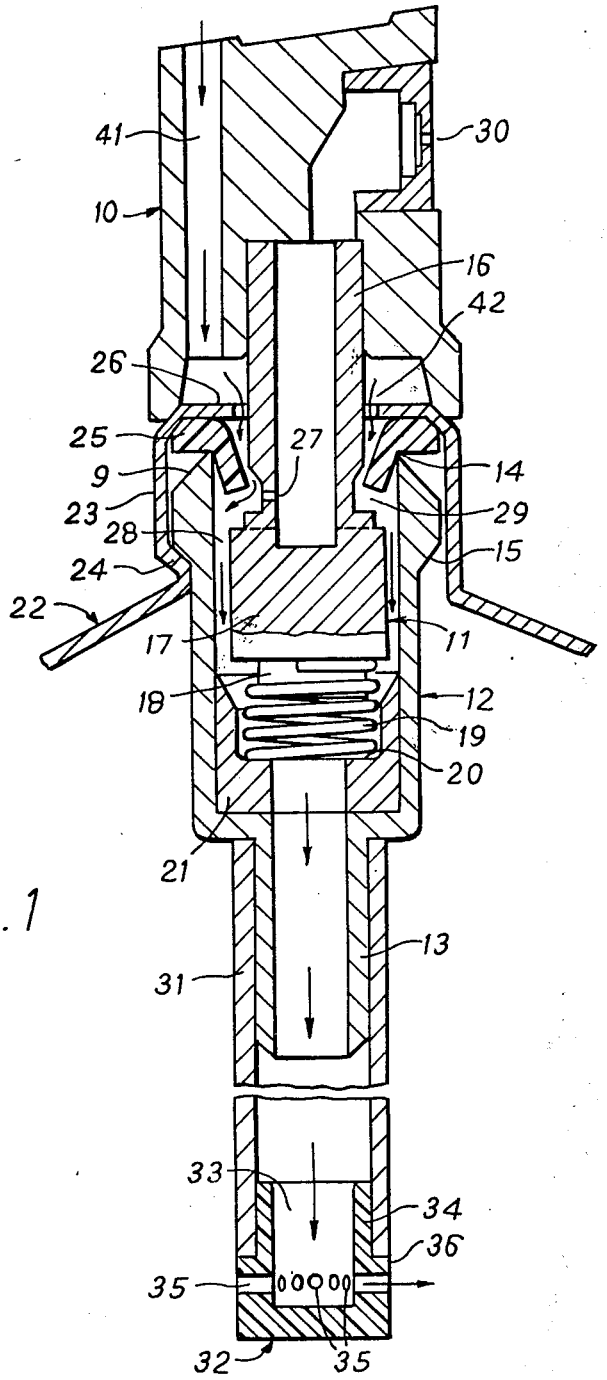
FIG. 1 shows the first valve embodying the invnetion, in central longitudinal section, and when assembled and fitted to an aerosol container.

Referring now to FIG. 1 of the drawings, a pressure filling valve is shown in relation to a button actuator 10 which in conventional manner is push-fitted onto the stem 11 of the valve and by depression of which the valve can, in use, be operated. The valve comprises a hollow circular housing 12 having a reduced diameter portion 13 at its lower end (as shown) and having its upper end terminated at a circular knife edge 14 surmounting an upwardly and inwardly inclined frustoconical relief surface 9. A further frustoconical surface 15, of opposite inclination to the relief surface, forms an annular shoulder on the housing exterior at some distance below the relief surface.

The valve stem 11 is located within the housing 12 so as to project beyond the knife edge 15 at a hollow end portion 16 to which the button actuator 10 is fitted. The bottom end of the stem is enlarged and solid. On its underside it carries an integral spigot 18 locating the top end of a compression spring 19 which biasses the stem upwardly (as shown) at all times. At its other end the spring 19 engages an annular shoulder 20 formed by an insert 21 in the housing 12.

The assembly further includes a mounting cup 22, shown only in part, to the periphery of which the mounting cup of a conventional aerosol container body (not shown) is attached in conventional manner. The cup has a cylindrical boss 23. During assembly of the valve to the mounting cup this boss is sleeved over the upper end of the valve housing and held in position by indented pips 24 which are subsequently formed around its periphery in engagement with the shoulder 15 on the housing.

An annular gasket 25 of a suitable elastomeric material is trapped firmly between the knife edge 14 and the plane end 26 of the boss 23. The knife edge engages the underside of the gasket approximately half-way across the radial width of the latter, so that the gasket overhangs the knife edge both on its inside and outside peripheries.

The bore in the upper portion 16 of the valve stem 11 is communicated by one or more radial orifices 27 with an annular clearance 28 which is provided between the valve stem and the housing 12 beneath the gasket 25. The orifice 27 enters the clearance 28 at a circumferential groove 29 formed around the stem portion 16. When the valve stem 11 is disposed in its uppermost position within the housing 12, this groove receives an inner peripheral margin of the gasket 25 in such a way that the orifice is closed and no product can leave the container. When, however, the valve stem is depressed to its lowermost position as shown in the drawing, the gasket rides out of the groove and a free passage for product is provided between the bore of the stem portion 13 and the spray orifice 30 of the button actuator 10. The liquid product in the container body is therefore dispensed as a spray from the orifice 30, driven by a gaseous pressurising medium which is provided in the container body as shortly to be described.

A dip tube 31 of a flexible plastics material is sleeved over the stem portion 13 so as in known manner extend generally axially along the container body to adjacent the body base. Conventionally, the bottom end of the dip tube will be open and spaced sufficiently from the body base to allow an unrestricted flow of product to enter the dip tube for dispensing. In accordance with the present invention, however, there is provided a member 32, preferably injection-moulded from a relatively rigid plastics material such as polystyrene, which is centrally formed with a blind bore 33 and is attached at a reduced diameter portion 34 to the bottom end of the dip tube. Below the portion 34 the member has the same external diameter as the dip tube at a cylindrical surface 36, and is formed with a plurality of regularly spaced radial holes 35 communicating the surface 36 with the bore 33.

Assembly of the container is conventional and will therefore not be described in detail. The only departure from conventional practice is the attachment of the member 32 to the dip tube 31. This may be achieved either before or after the dip tube is fitted to the housing 12 and is effected by push-fitting the portion 34 into the open end of the dip tube. If desired, the outer surface of the portion 34 may be provided with outwardly projecting beads, corrugations, pips or the like to engage the bore of the dip tube and so ensure that the member 32 is reliably retained in position after fitting to the dip tube.

The container is conventionally filled with the aerosol product to be dispensed, at a suitable stage in its assembly. The final step in the production of the container is the pressurising of the product by a pressurised gas such as carbon dioxide or nitrous oxide. In known manner—and as indicated by the unnumbered arrows—this gas is introduced into the container by a path which is generally that taken by the product as it passes through the valve for dispensing at the spray orifice 30, but in the reverse direciton. However, instead of passing via the spray orifice, the end portion 16 of the valve stem 11 and the communicating orifice(s) 27, the pressurising gas is instead introduced into the annular clearance 28 between the valve stem 11 and the housing 12 via a passage 41 specially provided in the button actuator 10, a clearance 42 between the end portion 16 and the surrounding bore of the plane end 26 of the mounting cup 22, and a clearance (unnumbered) which it creates as shown between the gasket 25 and valve stem 11 by deforming the gasket outwardly in that region. In the latter context it will be noted that the gas is introduced with the valve stem depressed, the gasket afterwards springing resiliently back into engagement with the valve stem so as to prevent the aerosol product or the pressurising gas from leaving the container except via the spray orifice 30 during dispensing.

Having passed along the dip tube 31 from the clearance 28 the pressurising gas entering the container bubbles into the aerosol product at the bottom of the container via the holes 35 in the member 32. The holes are individually of small diameter but substantial in number, (e.g. between 4 and 12) so that the pressurising gas enters the aerosol product as a large number of small bubbles rather than as a much smaller number of large and essentially sequential bubbles as would be the case in the absence of the member 32. The pressurising gas is thereby enabled to dissolve in the aerosol product at a substantially faster rate than would otherwise have occurred, with the result that the build-up of pressure in the container during pressurisation is substantially reduced and a greater filling pressure may be used for the gas than could otherwise safely be used. This in turn leads to shorter cycle times and resulting economies in production cost for the container as a whole.

Figure 2:
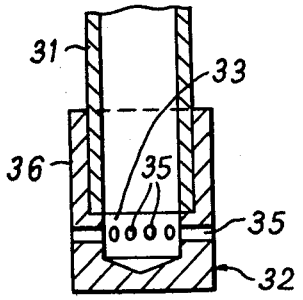
FIG. 2 shows the bottom end of the dip tube of the second valve, in central longitudinal section.

The embodiment of FIG. 2 is a valve which is identical to the valve of FIG. 1 except that the member 32 is push-fitted over the end of the dip tube 31 rather than into it. As before, the side wall of the member below the diptube is formed with a plurality of holes 35 communicating the outside surface 36 of the member 32 with its internal bore 33 to provide the desired diffusion effect.

FIG. 3 shows a further valve in which no member 32 is provided but instead the dip tube 31 is closed at its bottom end by a fin seal 43 integrally formed on the dip tube by a heat-sealing operation, and the holes 35 are made in the dip tube itself, for example for drilling.

In a further valve embodying the invention, depicted in FIG. 4 a member 32 is again provided. It has the same overall shape as that of FIG. 1 and is likewise push-fitted into the end of the dip tube 31. However, whereas the members 32 of FIG. 1 and FIG. 2 are of a gas-impervious plastics material and specially formed with the blind bore 33 and the holes 35, the member 32 of FIG. 4 is unapertured but made of a foamed plastics material of open-pore structure. A suitable material is foamed polyethylene.

It will be noted that in each of the arrangements described above the treatment of the dip tube 31 itself or, as appropriate, its provision with the member 32 to provide the desired diffusion effect has little or no effect on the function of the valve to dispense the aerosol product for use, the total flow area provided being sufficient to allow substantially unimpeded flow of the product into and up the dip tube.

In the arrangement shown in FIG. 5 the diffuser member 32 is generally as shown in FIG. 1, likewise comprising a plastics moulding which is formed with holes 35 on a common pitch circle and push-fitted into the open end of the dip tube 31. However, whereas in FIG. 1 the holes 35 are open to the cylindrical outside surface 36 of the diffuser member, in the arrangement of FIG. 5 the holes open into a peripheral groove formed around the diffuser member, and an annular sealing member 45 in the form of a band of an elastomeric material such as rubber is tightly received in the groove so as normally to close the holes from the product.

During filling, the pressurising gas supplied to the interior of the dip tube 31 as described above passes through the holes 35 and diffuses into the aerosol product in the container via the interface between the sealing member 45 and the adjacent surfaces defining the groove of the diffuser member. The sealing member deforms generally outwardly to allow this to occur. The gas enters the aerosol product as two annular streams one above and the other below the sealing member; on entering the product each of these streams breaks up into a number of small bubbles, so providing the required diffusion effect.

During dispensing, the sealing member 45 is held against the holes 35 not only by its own resilience but also by the radially inward pressure exerted on it by the aerosol product. The holes 35 are therefore closed, the flow of product into the dip tube 31 for dispensing being solely via an orifice 46 which is formed in the sealing member so as to communicate the bottom face 47 of the sealing member with the internal bore 48 thereof. The orifice 46 is designed to substantially restrict the flow rate of the product into the dip tube, so that a low spray rate results. The orifice 46 passes only an insignificant part of the pressurising gas flow during filling.

Although particularly described and shown in relation to the FIG. 1 embodiment, it will be appreciated that a sealing member 45 as depicted in FIG. 5 may likewise be provided for the embodiment of FIG. 2.

In the arrangements of FIGS. 1,2,3 and 5 the holes 35 are arranged on a single common pitch circle. If desired, however, the holes may be arranged on two or more vertically spaced pitch circles or in any other suitable configurations.

A further modification of the invention is illustrated in FIG. 6 where the diffuser member takes the form of a the container body beneath the dip tube. The container 52 is of conventional construction as referred to in the previously described forms with a valve assembly, indicated at 11', which is fitted to the mounting cup 22', the latter being secured to the body of the container 52 according to conventional practice as in the previously described forms with the dip tube 31' extending to a diffuser member 32' which takes the form of a pad of the foamed plastic material and is glued to the base 50 of the container beneath the end of the dip tube 31'. The pad is of such a thickness that the bottom end of the dip tube 31' indents it sufficiently to make an adequate seal but insufficiently to close the pores of its structure.

The invention is not to be considered as limited to the particular valve arranged shown in FIG. 1, but may have wide application to aerosol valves of the kind which are adapted for at least part of the pressurising medium, whether in gaseous form (as described) or in liquid form, to be introduced into the container via the dip tube.

What we claim is:

1. An aerosol container, which comprises a closed container body and a valve assembly mounted on the same, the valve assembly comprising a pressure filling valve and a dip tube attached to the valve and extending therefrom to a free end which is located adjacent, but spaced from, a remote end of the container body, a member of resilient foamed material, of open pore structure disposed against the said remote end of the container body, the said member being indented by the said free end of the dip tube in sealing relation thereto but insufficiently to close the pores of the member.

2. An aerosol container body fitted with a valve assembly which comprises a pressure filling valve and a dip tube attached to the valve and extending therefrom to a free end so as in normal use to pass a product to be dispensed to the valve from a remote end of the container body to which the valve is fitted, the valve assembly comprising a diffuser member of gas impermeable material with a plurality of holes provided adjacent the end of the dip tube and communicating with the bore of the dip tube, and including a band of elastomeric material encircling the diffuser member at the side wall thereof so as to close the holes except to a said pressurising medium admitted to the dip tube from the valve, as least one further hole being provided for product to enter the dip tube for dispensing the arrangement being such that pressurising medium passed along the dip tube to the free end thereof during pressurisation of an aerosol product emerges into the product finely divided into small bubbles.

3. A valve assembly according to claim 2, wherein the band of elastomeric material is located in a groove formed around the diffuser member at the side wall thereof.

4. A valve assembly according to claim 2, wherein the diffuser member has a single said further hole formed through the bottom thereof in alignment with the bore of the dip tube.

5. A valve assembly according to claim 2, wherein the diffuser member has a single said further hole formed through the bottom thereof in alignment with the bore of the dip tube.

* * * * *